US006125635A

United States Patent [19]

Nomura et al.

[11] Patent Number: 6,125,635

[45] Date of Patent: Oct. 3, 2000

[54] TEMPERATURE ADJUSTING DEVICE

[75] Inventors: Shinichi Nomura; Shinji Koyano; Yuichi Kinoshita, all of Narashino, Japan

[73] Assignee: Seiko Seiki Kabushiki Kaisha, Japan

[21] Appl. No.: 09/223,301

[22] Filed: Dec. 30, 1998

[51] Int. Cl.[7] ..... F25B 21/02

[52] U.S. Cl. ..... 62/3.2; 62/3.64; 62/434; 62/3.7

[58] Field of Search ..... 62/3.2, 3.64, 3.7, 62/434, 201

[56] References Cited

U.S. PATENT DOCUMENTS

| | | | |
|---|---|---|---|
| 5,154,661 | 10/1992 | Higgins | 62/3.2 X |
| 5,590,532 | 1/1997 | Bachman | 62/3.3 |
| 5,613,364 | 3/1997 | Higgins | 62/3.2 |
| 5,711,155 | 1/1998 | DeVilbiss et al. | 62/3.7 |
| 5,713,208 | 2/1998 | Chen | 62/3.7 |
| 5,918,469 | 7/1999 | Cardella | 62/3.7 |
| 5,931,000 | 8/1999 | Turner et al. | 62/3.2 |
| 5,996,353 | 12/1999 | Maxwell et al. | 62/3.2 |

FOREIGN PATENT DOCUMENTS 362175539 8/1987 Japan .

*Primary Examiner*—William Doerrler
*Assistant Examiner*—Chen-Wen Jiang
*Attorney, Agent, or Firm*—Adams & Wilks

[57] ABSTRACT

A temperature adjusting device has an air-tight container. A thermoelectric element is disposed in the air-tight container and has first and second opposite surfaces each capable of radiating and absorbing heat through a Peltier effect. A first heat exchanger is disposed in the air-tight container for performing heat exchange between a thermally conductive first medium and the first surface of the thermoelectric element. A tank is disposed in the air-tight container and is connected to an inlet side of the first heat exchanger for storing the first medium. A second heat exchanger is disposed in the air-tight container for performing heat exchange between a thermally conductive second medium and the second surface of the thermoelectric element. A pump circulates the first medium through the first heat exchanger. A temperature sensor detects a temperature of the first medium circulated by the pump. A controller controls an electric current supplied to the thermoelectric element so that a temperature detected by the temperature sensor becomes equal to a preselected temperature value.

19 Claims, 14 Drawing Sheets

TEMPERATURE ADJUSTING DEVICE

BACKGROUND OF THE INVENTION

1. Field of the Invention

The present invention relates to a temperature adjusting device that heats/cools a fluid using a thermoelectric element utilizing a Peltier effect and can adjust a temperature of the fluid.

2. Description of the Related Art

A conventional temperature adjusting device of this type is disclosed, for instance, in U.S. Pat. No. 5,613,364.

This conventional temperature adjusting device has a thermoelectric element (Peltier element), a first heat exchanger contacted with one side surface of this thermoelectric element for performing the heat exchange with a fluid, a second heat exchanger contacted with the other side surface of the thermoelectric element for performing the heat exchange with the fluid, a refrigerant tank, and so on. These components are accommodated within a given case.

The conventional device, however, suffers from the following problems:

1) The refrigerant tank is simply accommodated within the case, and thus is not in a thermally insulative condition. Consequently, the heat exchange efficiency is poor since the heat is radiated or absorbed through the outer peripheral surfaces of the refrigerant tank.
2) The thermoelectric element is simply accommodated within the case, and thus is not in the thermally insulative condition. Consequently, the heat exchange efficiency is poor since the heat is radiated or absorbed through the outer peripheral surfaces of the cooling section of the thermoelectric element.
3) Since the thermoelectric element is not in the thermally insulative condition similarly, dew condensation takes place on the surfaces of the thermoelectric element, and the service life thereof is shortened.
4) The heat radiating side of the thermoelectric element is cooled by a service water allowed to flow in the second heat exchanger. This cooling is not so appropriate, and the cooling performance is insufficient.
5) The arrangement of the thermoelectric elements is not appropriate, and consequently the temperature of the medium (fluid) flowing in the first heat exchanger is non-uniform, and it is difficult to adjust the temperature accurately.
6) Since a Peltier element having a so-called sandwich structure (a standard type Peltier module) is used as the thermoelectric element, the heat exchange efficiency is poor.

SUMMARY OF THE INVENTION

It is, therefore, an object of the present invention to provide a temperature adjusting device which is improved in reliability and life cycle by preventing the formation of dew on a thermoelectric element, and which can perform the heat exchange efficiently.

It is another object of the present invention to provide a temperature adjusting device which is improved in heat exchange efficiency, and which is improved in performance by making temperature of a medium uniform.

To attain the above-noted objects, a temperature adjusting device according to the present invention comprises: a thermoelectric element having first and second opposite surfaces, each capable of radiating and absorbing heat through Peltier effect; a first heat exchanger for performing heat exchange between a thermally conductive first medium and the first surface of the thermoelectric element; a second heat exchanger for performing heat exchange between a thermally conductive second medium and the second surface of the thermoelectric element; a pump for circulating the first medium to pass through the first heat exchanger and a device to be temperature-controlled; a temperature sensor for detecting a temperature of the first medium circulated by the pump; and control means for controlling an electric current supplied to the thermoelectric element so that a temperature detected by the temperature sensor becomes equal to a target value; and wherein the thermoelectric element, the first heat exchanger and the second heat exchanger are accommodated within an air-tight container.

In the present invention, a tank for storing the first medium may be provided on an inlet side of the first heat exchanger, and the tank may be accommodated within the air-tight container. As for the above thermoelectric element, a skeleton type Peltier element is preferably used to decrease the heat resistance and improve the performance of heating and cooling the thermally conductive medium.

It is preferable, in view of enhancing thermally insulative and moisture-preventive effects, to arrange the above air-tight container to be capable of being pressure-decreased by a vacuum pump. A dry air or a dry inert gas may be filled inside the above air-tight container. A gas or a liquid is used as each of the first and second media, and if the liquid is used, a liquid high in electrically insulative and thermally conductive properties is preferably used.

In the present invention, the provision of temperature adjusting means for adjusting a temperature of the second medium to be constant is preferable in view of improving the heat exchange efficiency of the medium. The temperature adjusting means includes: a thermoelectric element for heating and cooling the second medium; a tank for storing the second medium therein; a pump for circulating the second medium; a temperature sensor for detecting a temperature of the second medium; and control means for controlling an electric current supplied to the thermoelectric element so that the temperature detected by the temperature sensor becomes equal to a target value.

It is preferable, in view of solving problem associated with the use of fan for cooling the pump, that heat generated from the pump is radiated using the second medium (for example, service water) to be supplied to the second heat exchanger. It is preferable, in view of improving the heat exchange efficiency, that each of the first and second heat exchanger has a portion that is contacted with the thermoelectric element and that is provided with comb-type fins, and each of the fins has pleats since the surface area of the fins can be increased and the flow of the fluid can be disturbed.

In the present invention, a plurality of the thermoelectric elements are provided, which are arranged at predetermined intervals circumferentially and longitudinally to form a hollow tetrahedron, the first heat exchanger is formed inside the tetrahedron, and second heat exchangers are disposed outside the tetrahedron concentrically to the first heat exchanger. With this arrangement, the temperature of the first medium can be made uniform.

In the present invention, two thermoelectric element arrayed surfaces are formed by arranging a plurality of the thermoelectric elements at predetermined intervals longitudinally and laterally on two opposing surfaces spaced by a predetermined distance, the first heat exchanger is formed between the thermoelectric element arrayed surfaces, and second heat exchangers are formed on outer sides of the thermoelectric element arrayed surfaces. With this arrangement, the temperature of the first medium can made uniform, and a heat exchange section cam be made compact.

In the present invention, the first heat exchanger may be constructed as a heat exchanger tank that functions also as the tank, and this heat exchanger tank may be accommodated within the air-tight container.

In this case, it is preferable, in view of improving a thermoelectric effect, that the heat exchanger tank is divided into a plurality of vessels by a plurality of walls provided at predetermined intervals in a longitudinal direction, and the walls are respectively provided with communication holes arranged at predetermined angular intervals so as to communicate the vessels one another, since the liquid flows as a vortex flow.

DETAILED DESCRIPTION OF THE PREFERRED EMBODIMENTS

Preferred embodiment of the present invention will be described in detail with reference to the drawings.

Figure 1:
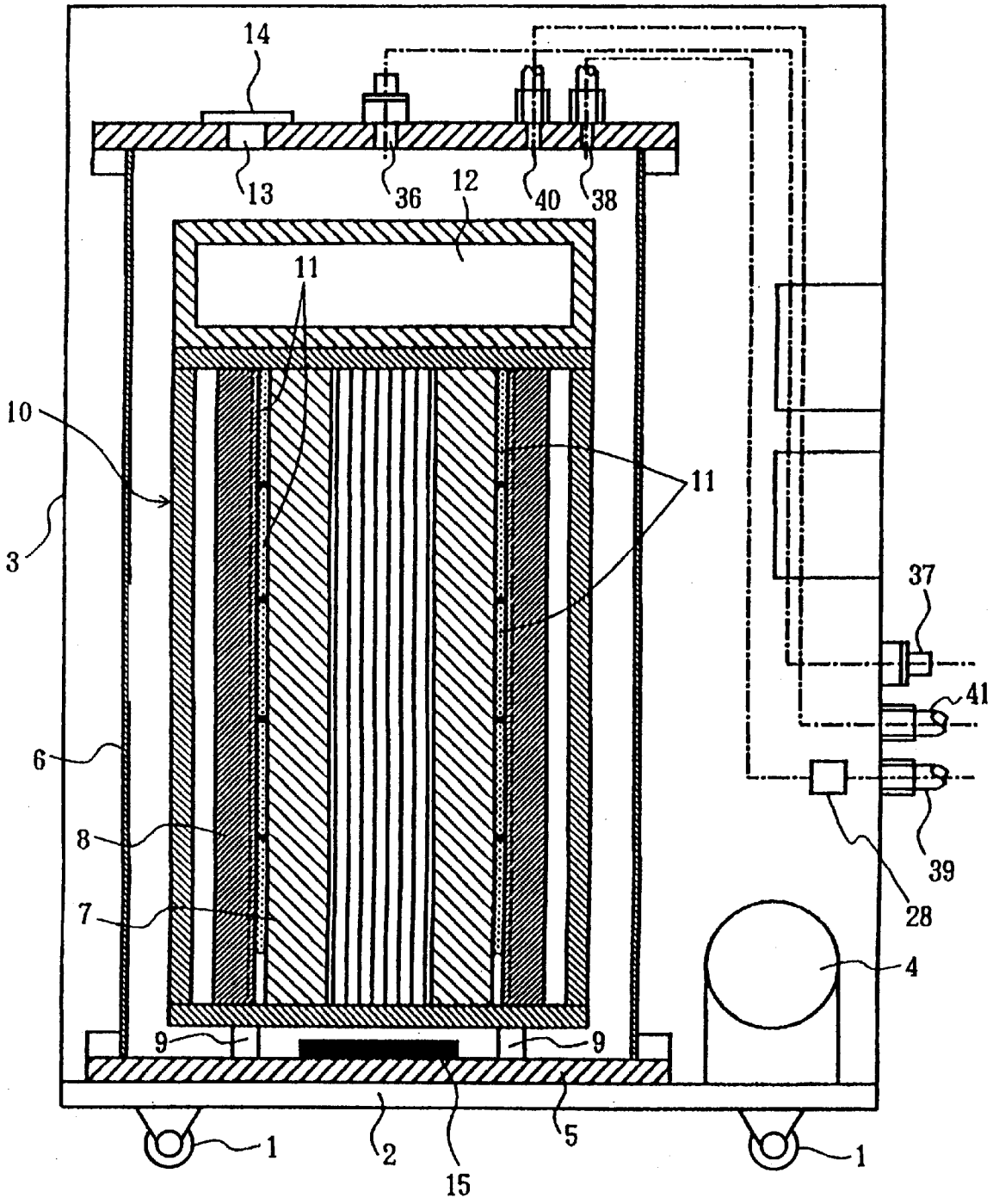
FIG. 1 is a longitudinally sectional view showing the entire arrangement of a first embodiment in accordance with the present invention.
Figure 2:
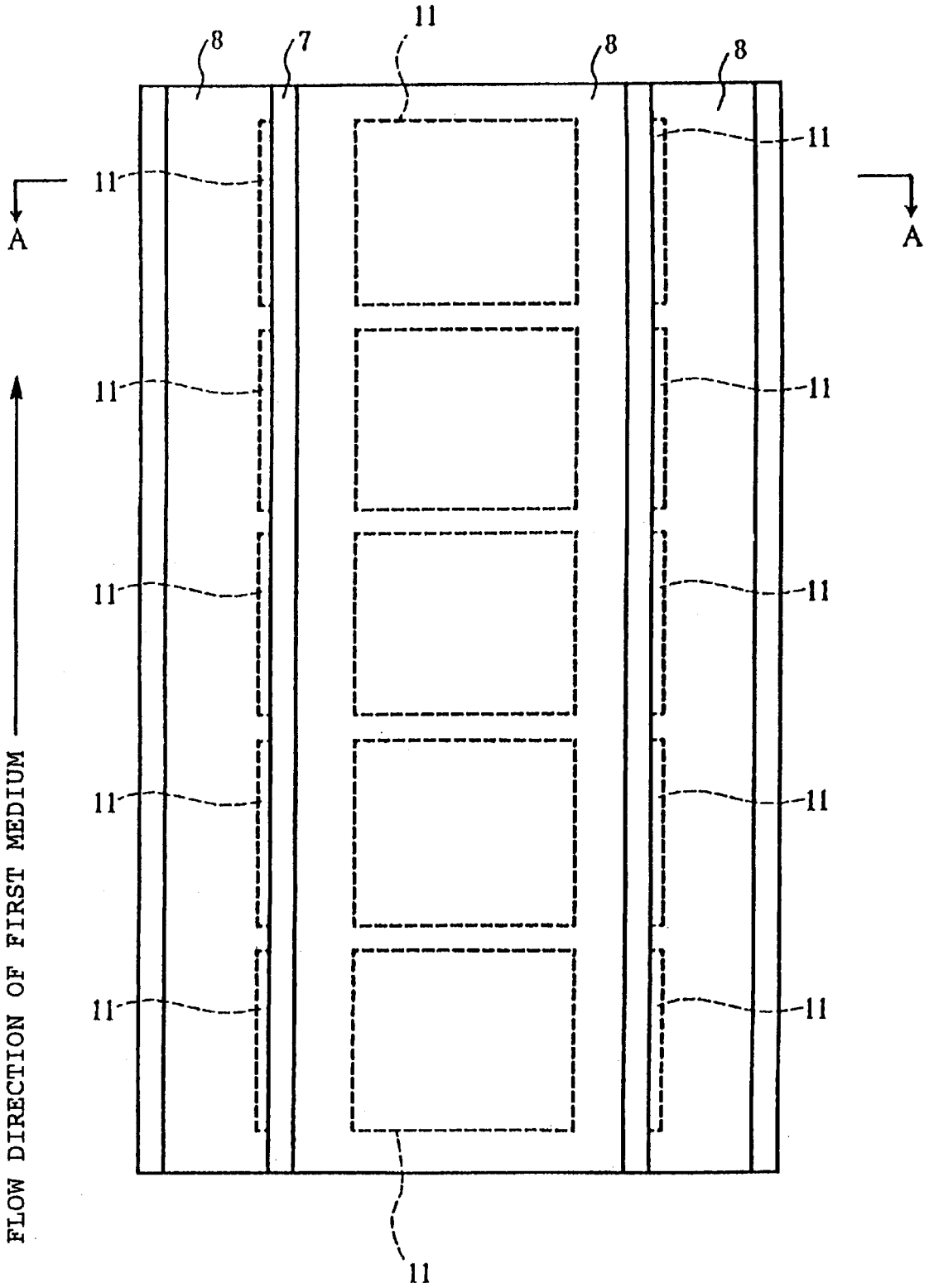
FIG. 2 is a elevational view showing a heat exchange section per se taken from FIG. 1.
Figure 3:
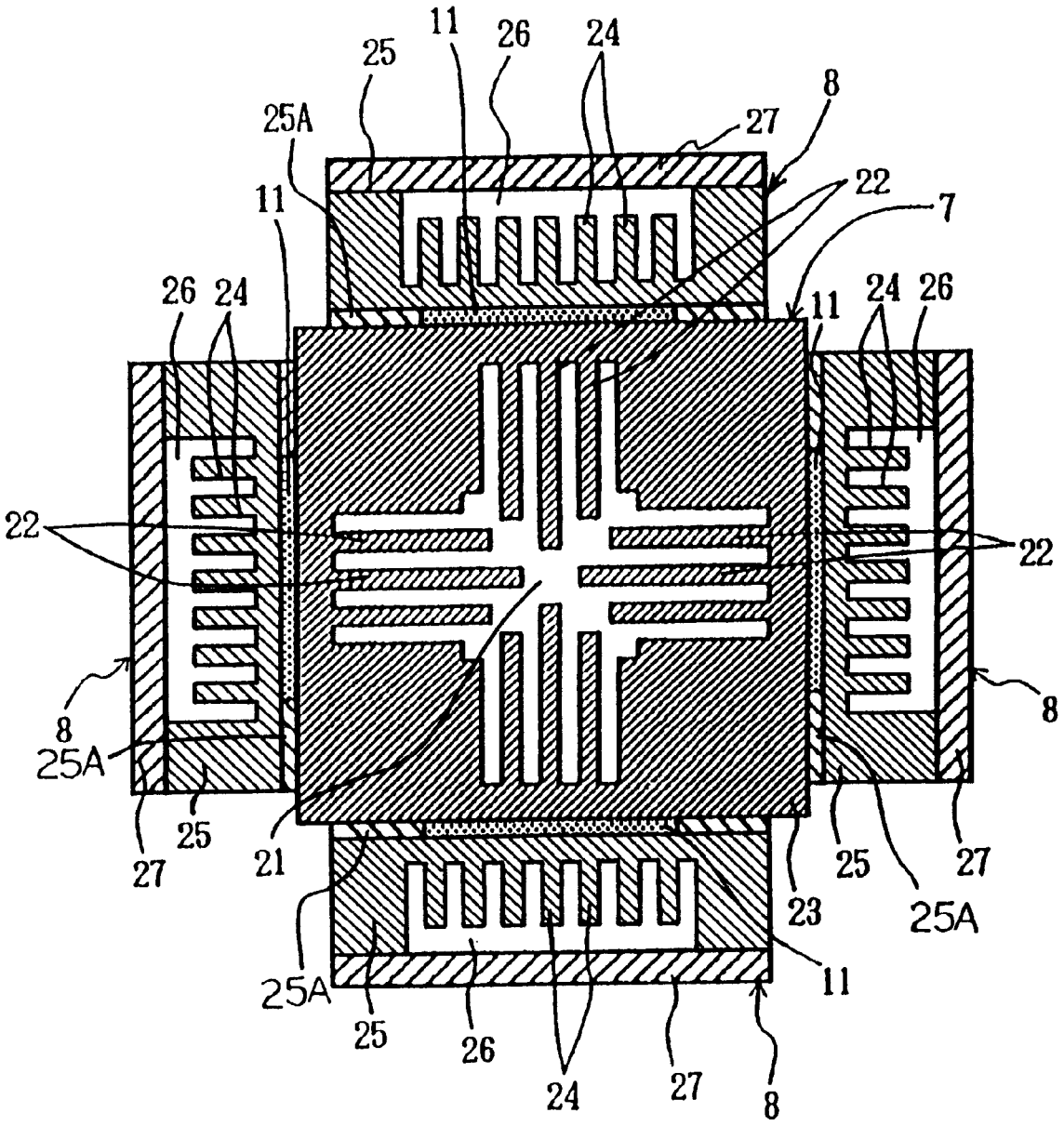
FIG. 3 is a sectional view taken along the line A—A of FIG. 2.
Figure 4:
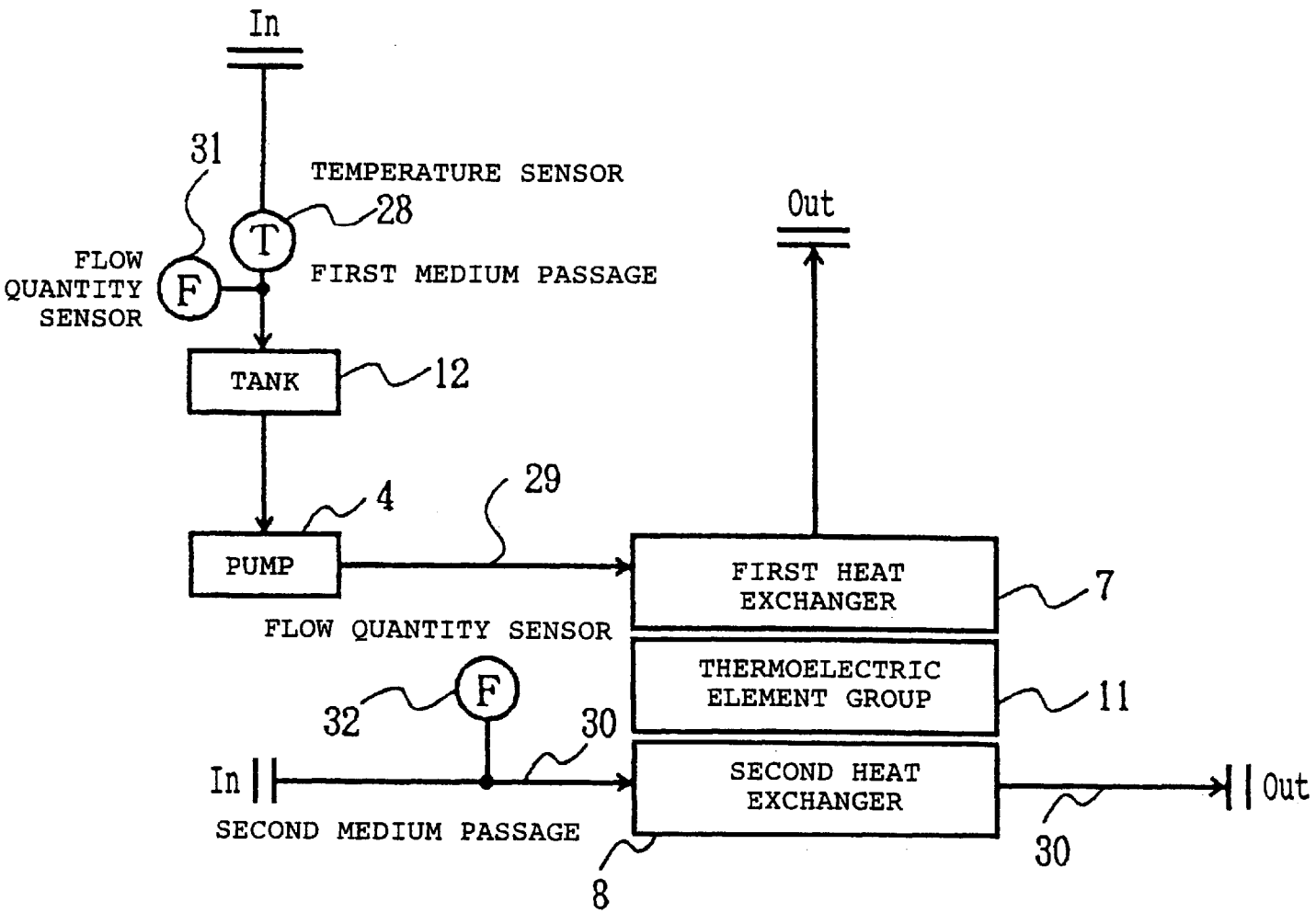
FIG. 4 is a schematic view showing a piping arrangement in the first embodiment.

FIG. 1 is a longitudinally sectional view showing an entire arrangement of a temperature adjusting device according to a first embodiment of the present invention. FIG. 2 is an elevational view showing an heat exchange section taken from the device shown in FIG. 1. FIG. 3 is a sectional view taken along the line A—A of FIG. 2. FIG. 4 is a schematic view showing a piping arrangement in the first embodiment.

As shown in FIG. 1, the temperature adjusting device according to the first embodiment includes a base 2 provided with casters 1, and an outer casing 3 mounted on the base 2 for housing components described later therein.

A pump 4 for circulating a first medium is installed on the base 2. A fixing member 5 is fixed onto the base 2, and an air-tight container 6 is provided on this fixing member 5.

Provided within the air-tight container 6 are a heat exchange section 10 made up of a first heat exchanger 7 and second heat exchangers 8 and supported on the fixing member 5 by thermal insulators 9, a plurality of thermoelectric elements 11 interposed between and closely contacted with the first and second heat exchangers 7 and 8, and a tank 12 mounted on the upper portion of the heat exchange section 10 for storing the first medium therein.

The first heat exchanger 7 serves to exchange the heat between the thermally conductive first medium and one side of the thermoelectric elements 11, as described later.

The second heat exchanger 8 serves to exchange the heat between the thermally conductive second medium and the other side of the thermoelectric elements 11, as described later.

Each of the thermoelectric elements 11 is the so-called standard type Peltier module (Peltier element) that is made up of a combination of a plurality of P-type and N-type semiconductors and that radiates (generates) and absorbs the heat by the Peltier effect. The thermoelectric element 11 is substantially in the form of a plate having two opposite surfaces, each of which radiates or absorbs the heat depending on the flow direction of electric current.

An exhaust hole 13 is provided on the upper portion of the air-tight container 6 to discharge the air from the air-tight container 6 with the aid of a vacuum pump (not shown). This exhaust hole 13 can be sealingly closed by a vacuum sealing plug 14. With the pressure decrease within the air-tight container 6, the thermally-insulative and vapor barrier properties can be assured within the air-tight container 6.

To maintain the vacuum within the air-tight container 6, a getter material 15 for absorbing gases may be disposed on the bottom portion within the air-tight container 6.

It is not essential to secure the vacuum within the air-tight container 6, and alternatively, dry air, inert gas or the like may be filled within the air-tight container 6.

Next, the arrangements of the heat exchange section 10 and the thermoelectric elements 11 provided within the air-tight container 6 will be described in detail.

As shown in FIGS. 2 and 3, the heat exchange section 10 includes the first heat exchanger 7 and the four second heat exchangers 8 concentrically arranged with respect to the first heat exchanger 7.

One side of each of four thermoelectric elements 11 at the same level is closely contacted with corresponding one of four outer peripheral surfaces of the first heat exchanger 7, whereas the other side of each of the four thermoelectric elements 11 is closely contacted with an inner surface of the corresponding second heat exchanger 8.

As shown in FIG. 1, the thermoelectric elements 11 thus arranged are provided at predetermined intervals along the height of the first heat exchanger 7 so that the sides of the each of the thermoelectric elements 11 are closely contacted with the outer peripheral surface of the first heat exchanger 7 and the inner surface of the second heat exchanger 8, respectively.

As shown in FIGS. 2 and 3, the first heat exchanger 7 is constructed generally by a hollow square pole block 23 made of material, such as copper, high in thermally conductive property. A first medium passage 21 is formed inside the block 23 along the length thereof. One side of each of the thermoelectric elements 11 is closely contacted with the four outer peripheral surfaces of the block 23 as described above.

As shown in FIG. 3, the first medium passage 21 is formed with a plurality of recessed portions (four recessed portions are provided in this embodiment) that are located opposite from the outer peripheral surfaces with which the thermoelectric elements 11 are closely contacted, and that elongate along the length of the block 23. In each of the recessed portion, comb-like fins 22 are provided, which are generally formed by three parallel plates, and which elongate along the length of the first medium passage 21 and project toward the center of the first medium passage 21.

As shown in FIGS. 2 and 3, the second heat exchanger 8 includes a fin-equipped member 25 equipped with a plurality of longitudinally elongating fins 24 (seven fins are provided in this embodiment), and a plate 27 coupled to this fin-equipped member 25 to form a second medium passage 26. Both of the fin-equipped member 25 and the plate 27 are high in thermally conductive property.

As shown in FIG. 3, the fin-equipped member 25 is closely contacted with the other side of the thermoelectric element 11, but thermally insulated from the parallelepiped columnar block 23 by a thermally insulative member 25A made of material, such as tellurin, which is high in thermally insulative property. The thermally insulative member 25A covers or is closely contacted with the outer peripheral surface of the thermoelectric element 11.

Electric current supplied to the thermoelectric element 11 is controlled so that a temperature detected by a temperature sensor 28 (platinoid sonometer) converges to a target value. The temperature sensor 28 is provided on the flow passage between a flange 39 mounted on the outer case 1 and the tank 12 within the air-tight container 6.

As shown in FIG. 1, to supply the electric power to each of the thermoelectric elements 11 within the air-tight container 6, a through-hole 36 for passing a cable (not shown) therethrough is provided on the upper portion of the air-tight container 6, and a connector 37 is attached to the side surface of the outer case 1.

To circulate the first medium to an external device (not shown), the outer case 1 is provided with a flange 41 through which the first medium is supplied to the external device, and the flange 39 through which the first medium is returned from the external device. A flange 40 is provided on the upper portion of the air-tight container 6 to connect the flange 41 to the first heat exchanger 7 located within the air-tight container 6. Similarly, a flange 38 is provided on the upper portion of the air-tight container 6 to connect the flange 39 to the tank 12 located within the air-tight container 6. These flanges are connected to each other through pipes covered by thermally insulative members.

A flange (not shown) is provided on the air-tight container 6 to connect the pump 4 located within the outer case 1 to the tank 12 and the first heat exchanger 7. This flange is connected to the pump 4 through a pipe.

Similarly, flanges are provided on the air-tight container 6 and the outer case 1 to supply and discharge the second medium to and from the second heat exchanger 8 located within the air-tight container 6. These flanges are connected through pipes.

The detailed piping arrangements for the first and second media to flow are described later.

Next, the detailed piping arrangements in the first embodiment will be described with reference to FIG. 4.

In the first embodiment, as shown in FIG. 4, the piping is arranged so that the activation of the pump 4 circulates the first medium in order of the tank 12, the pump 4, the first heat exchanger 7, and the external device (not shown) that is the subject to be cooled or heated. The tank 12, the pump 4 and the first heat exchanger 7 are connected in series through the first medium passage 29 formed, for instance, by pipes.

A flow quantity sensor 31 is disposed within the tank 12 or in a portion of the first medium passage 29 to check whether the first medium flows. The temperature sensor 28 is disposed in a portion of the first medium passage 29 before the inlet of the tank 12.

The second medium passage 30 formed, for instance, by pipes, is connected to inlet and outlet sides of the second heat exchanger 8 so that the second medium such as service water is supplied thereto and then discharged therefrom. The second medium is allowed to flow constantly when the device is in operation, in order to efficiently perform the heat transfer from the first medium. A flow quantity sensor 32 is disposed in a portion of the second medium passage 30 to check whether the second medium flows.

As for the first and second media described above, a gaseous material, such as helium and HFC (hydrofluorocarbon) group gas, and a liquified material, such as fluoro-group inert liquid and silicon oil which are high in electrically insulative and thermally conductive properties, may be used. For example, in case where the external device is a plasma etching device, it is preferable to use the fluoro group inert liquid as the first media since the plasma of high electric power and high frequency is generated.

A control system for the first embodiment thus constructed will be described with reference to FIG. 5.

Figure 5:
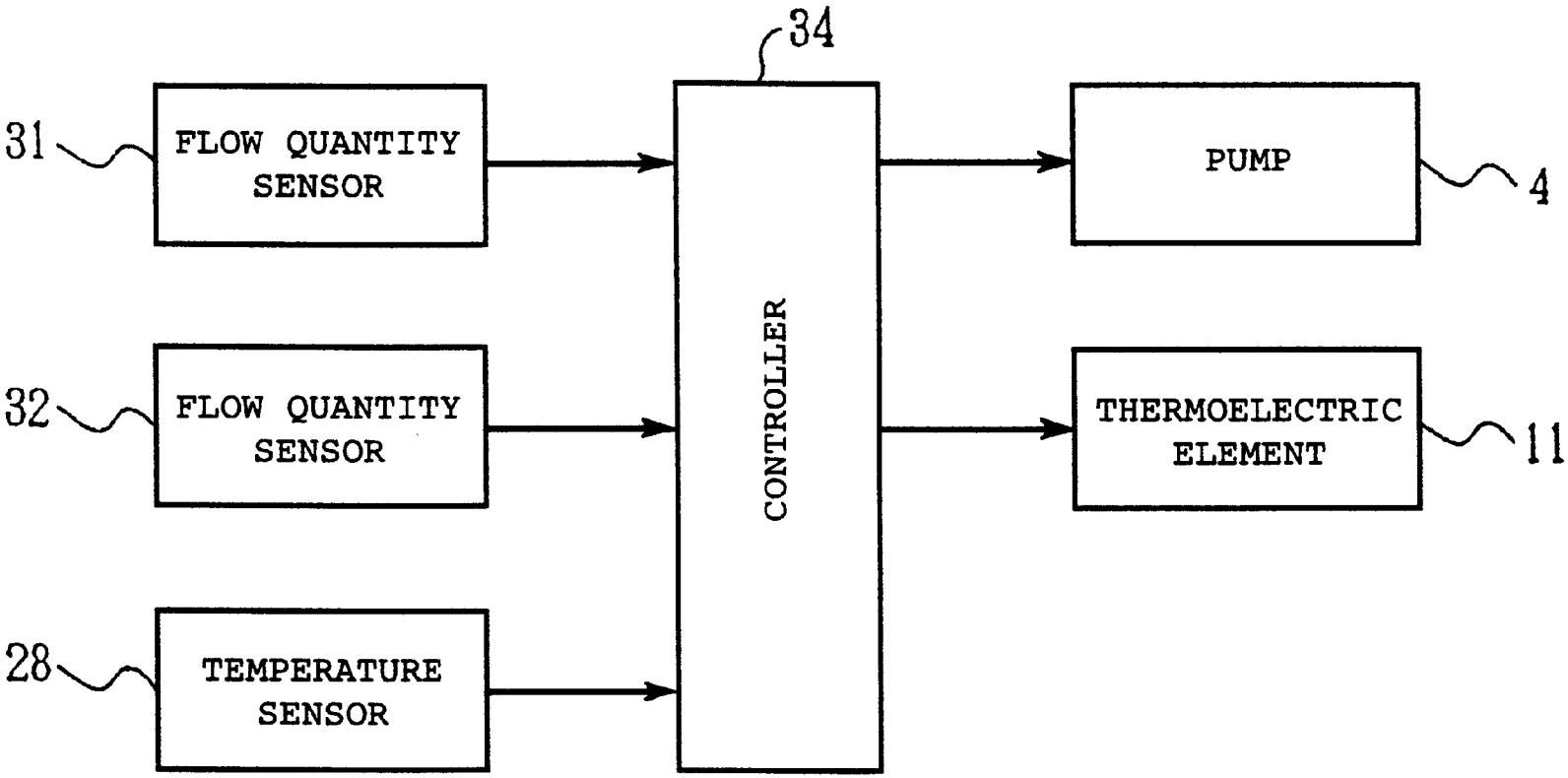
FIG. 5 is a block diagram showing an arrangement of a control system in the first embodiment.

In the first embodiment, as shown in FIG. 5, the components are controlled by a controller 34.

That is, the controller 34 is arranged so that detection signals of the temperature sensor 28, the flow quantity sensor 31 and the flow quantity sensor 32 are input to the input side of the controller 34.

The output side of the controller 34 is connected to the pump 4, which is to be controlled by the controller 34, and thermoelectric elements 11 illustrated in FIG. 2 or others.

Next, the operation of the first embodiment thus constructed will be described.

When the pump 4 is activated in response to the operation command from the controller 34, the first medium is circulated in the order of the tank 12, the pump 4, the first heat exchanger 7 and the external device (not shown).

In conjunction with this, the detection signal of the temperature sensor 28 is input to the controller 34. The controller 34 controls the supply current to each of the thermoelectric elements 11 in FIG. 2 and polarity to heat or cool the first medium so that the detected temperature becomes a set value. That is, if the detected temperature is higher than the set value, the current is supplied increasingly or decreasingly with the certain polarity which cools the surface contacted with the first heat exchanger 7. On the other hand, if the detected temperature is smaller than the set value, the polarity due to the current flowing direction is inverted and the electric current is controlled. As for this control method, a generally known PID control is used.

In order to efficiently transfer the heat from the first medium in the heating or cooling of the first medium, the second medium is always supplied to the second heat exchanger 8 from the external side, and then discharged therefrom.

If the controller 34 judges that the abnormal condition occurs with the aid of the flow quantity sensors 31, 32, or on the basis of the detection temperature detected by the temperature sensor 28, or the like, the controller 34 generates an alarm signal to inform an operator of the abnormal condition, and concurrently the operation of each component such as the pump 4 and the thermoelectric elements 11 are stopped.

Since the inside of the air-tight container 6 is pressure-decreased and thus in a vacuum condition, no thermal transfer occurs from portions other than the outside of the tank 12 and the thermoelectric elements 11 of the heat exchange section 10, and therefore no dew is formed on the tank 12 and the thermoelectric elements 11. Further, since the inside of the air-tight container 6 is of the thermally insulative structure, the heat exchange efficiency is improved.

Although the tank 12 for storing the first medium is connected to the inlet side of the first heat exchanger 7 in the first embodiment, the tank 12 may be dispensed with.

Next, a second embodiment of the present invention will be described with reference to FIGS. 6A and 6B.

Figure 6A:
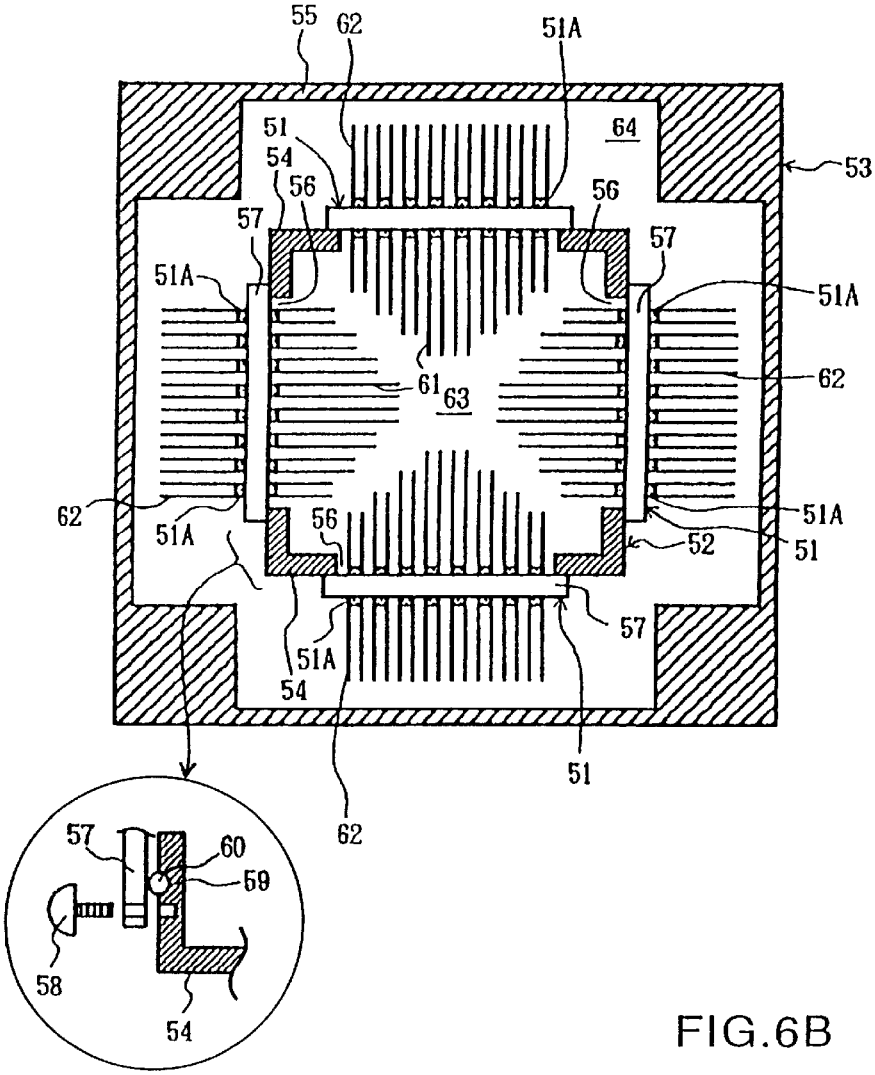
FIG. 6A is a sectional view showing a heat exchange section in a second embodiment of the present invention.
Figure 6B:
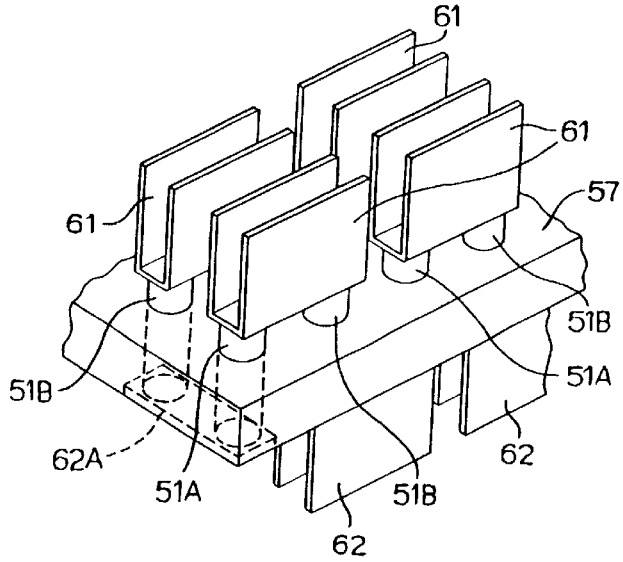
FIG. 6B is a perspective view showing an arrangement example of a skeleton type thermoelectric element.

In the second embodiment, skeleton type thermoelectric elements 51 as shown in FIGS. 6A and 6B are used in place of the thermoelectric elements 11 of the first embodiment, and in association therewith the first and second heat exchangers 7 and 8 of the first embodiment is replaced with first and second heat exchangers 52 and 53 as shown in FIG. 6A.

That is, in the second embodiment, as shown in FIG. 6A, a hollow inner square pole cylinder 54 onto which the skeleton type thermoelectric elements 51 are mounted is concentrically arranged with respect to a hollow outer square pole cylinder 55. The inner cylinder 54 made of thermally insulative member is surrounded by the outer cylinder 55.

On the four surfaces of the inner square pole cylinder 54 at the same height levels, there are provided rectangular holes 56 for disposing the skeleton type thermoelectric elements 51. These rectangular holes 56 are also provided at predetermined intervals on each of the four surfaces along the height.

The end of a separator 57 is fixed to the periphery of the hole 56 with a plurality of screws 58 so that the skeleton type thermoelectric element 51 per se is located at the position of the hole 56. As shown by an enlarged portion of FIG. 6A, a groove 59 is provided around the hole 56, and an O-ring 60 is fitted into the groove 59. With this arrangement, an air-tight property can be ensured when the separator 57 is mounted onto the rectangular columnar cylinder 54.

Here, as shown in FIG. 6B, the skeleton type thermoelectric element 51 is constructed such that P-type semiconductor elements 51A and N-type semiconductor elements 51B are alternately implanted into a large number of holes provided laterally and longitudinally in the separator 57. The adjacent semiconductor elements 51A and 51B are connected by U-shaped fins 61 and 62 alternately with respect to the separator 57 so that the U-shaped fin 61 and 62 function as electrodes. Depending on the flow direction of the electric current, the U-shaped fins on one side with respect to the separator 57 generate the heat, whereas the U-shaped fins on the other side absorb the heat.

In addition, as shown in FIG. 6B, the P-type semiconductor element 51A and the N-type semiconductor element 51B disposed on the end portion are connected to each other by a planar electrode 62A.

The use of the skeleton type thermoelectric elements 51 provides the following advantages: That is, in contrast to the conventional arrangement in which both sides of the standard type thermoelectric element are made of alumina ceramics material or the like, and thermal resistance of this material deteriorates the thermal conductivity, the skeleton type thermoelectric element 51 is arranged such that the U-shaped fins 61 and 62 are directly formed on the semiconductor element portion. Therefore, the thermal resistance is small, and consequently the thermal conductivity is improved.

With this arrangement, a first medium passage 63 through which the first medium is passed is formed inside the inner square pole cylinder 54, and a second medium passage 64 through which the second medium is passed is formed in a portion surrounded by the square pole cylinders 54 and 55.

As described above, since the second embodiment employs the skeleton type thermoelectric element 51, the heat generating portion and the heat absorbing portion can be directly contacted with the first and second media, so that the thermal resistance can be decreased and the heating and cooling efficiency can be enhanced.

Since the electric current passage is exposed in case of the skeleton type thermoelectric element 51, the liquid hight in electrically insulative property and high in thermally conductive property is preferably used as first and second media. Alternatively, other liquid and gas may be used with the electric current passage coated by thermally conductive and electrically insulative resin.

Next, a third embodiment of the present invention will be described with reference to FIGS. 7 and 8.

The third embodiment utilizes, in place of the first heat exchanger 7 of the first embodiment, a heat exchanger tank 71 which serves to perform the heat exchange with the first media as well as to stores the first media therein. With this arrangement, the tank 12 of the first embodiment is dispensed with.

Figure 7:
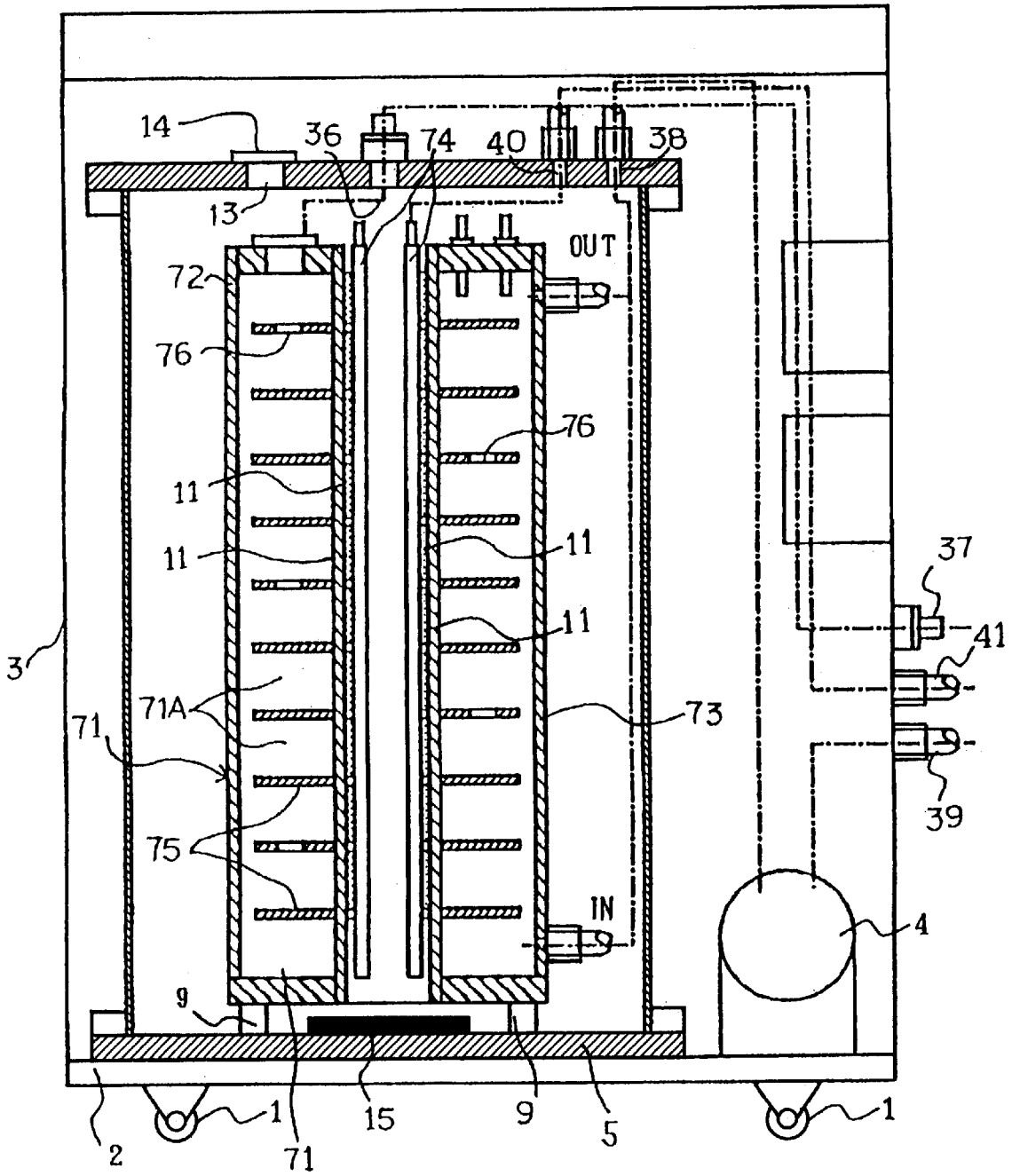
FIG. 7 is a longitudinally sectional view showing the entire arrangement of a third embodiment in accordance with the present invention.
Figure 8:
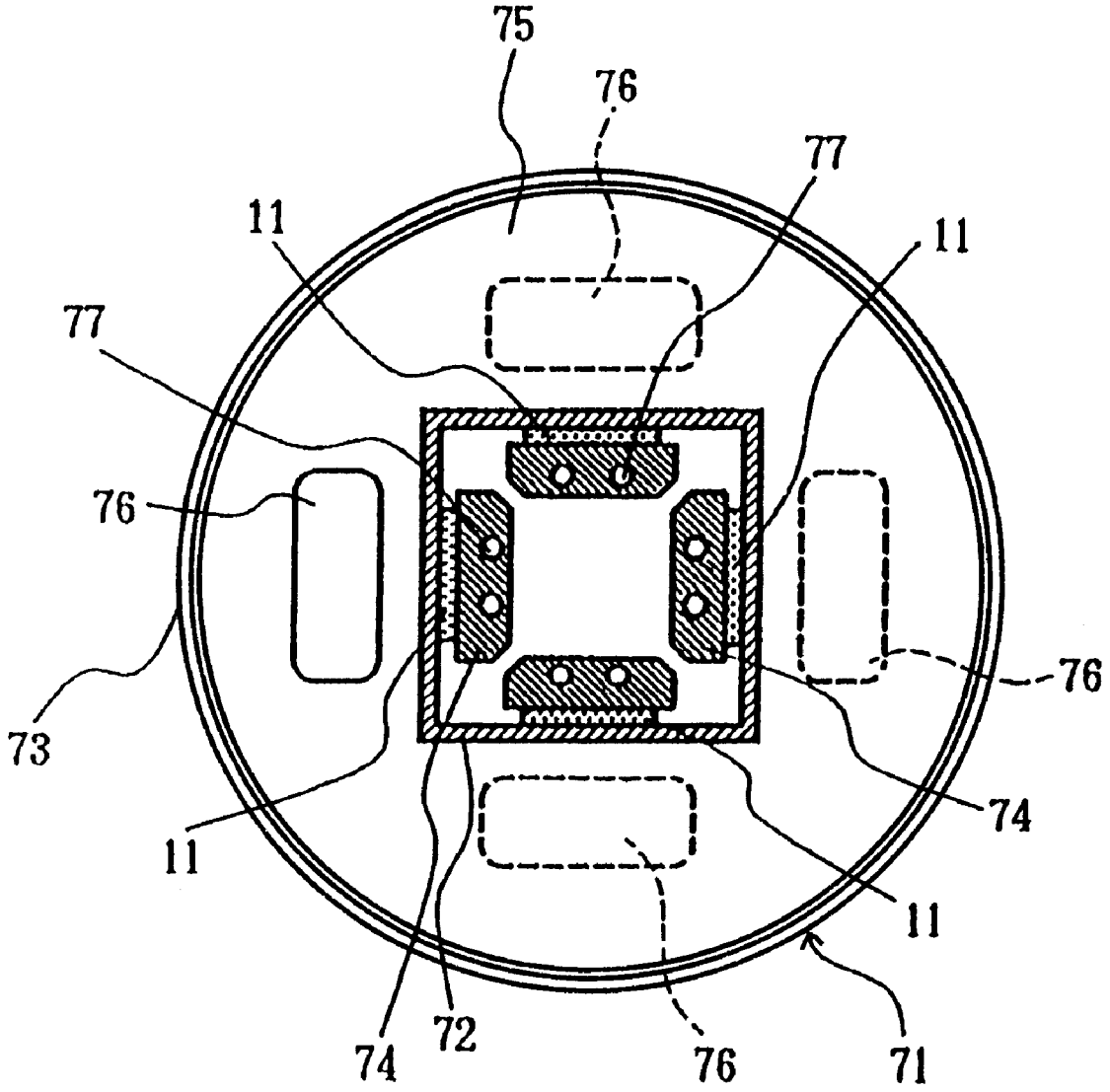
FIG. 8 is a sectional view showing a heat exchange section in FIG. 7.

As shown in FIGS. 7 and 8, the third embodiment is arranged so that a hollow square pole cylinder 72 on which thermoelectric elements 11 are mounted is surrounded by and arranged concentrically to a hollow cylinder 7, the heat exchanger tank 71 is formed in a space surrounded by the square pole cylinder 72 and the cylinder 73, and four second heat exchangers 74 are provided within the square pole cylinder 72.

On the four inner surfaces of the square pole cylinder 72 at the same height level, there are disposed the thermoelectric elements 11 whose one side surfaces are closely contacted with the inner surfaces of the cylinder 72. The thermoelectric elements 11 are disposed at predetermined intervals along the height on each of the four inner surfaces, and the one side surfaces thereof are closely contacted with the inner surfaces of the cylinder 72.

As shown in FIG. 7, the heat exchange tank 71 is divided into a plurality of vessels 71A by a plurality of fins 75 mounted on the outer peripheral surfaces of the square pole cylinder 72 at predetermined intervals along the height. Each of the fins 75 is provided with a communication hole 76. The communication holes 76 of the fins 75 are arranged at predetermined angular intervals (90 degree in this embodiment) in a circumferential direction that is perpendicular with respect to the length direction. The vessels 71A can be communicated with one another through these communication holes 76.

As shown in FIGS. 7 and 8, each of the fins 75 is mounted so as to be directed radially, and a gap of a predetermined width is provided between the outer circumferential surface of each fin 75 and the inner circumferential surface of the cylinder 73.

The four second heat exchanger 74 are provided inside the square pole cylinder 72 to elongate in the height direction. The other surfaces of the thermoelectric elements 11 are closely contacted with the second heat exchanger 74. A second medium passage 77 through which the second medium is passed is provided in each of the second heat exchangers 74 to extend in the height direction.

Since the third embodiment thus constructed has the heat exchange tank 71 which serves to perform the heat exchange with the first medium as well as to store the first medium therein, the tank shown in FIG. 1 can be omitted.

Since the heat exchange tank 71 is divided into the plural vessels 71A by the fins 75, the fins 75 are respectively provided with the communication holes 76 arranged at predetermined angular intervals, and the vessels 71A are communicated with one another through the communication holes 71A, the first medium (fluid) flows as a vortex flow to thereby enhance the thermally conductive effect.

Next, a fourth embodiment of the present invention will be described with reference to FIGS. 9 and 10.

Figure 9:
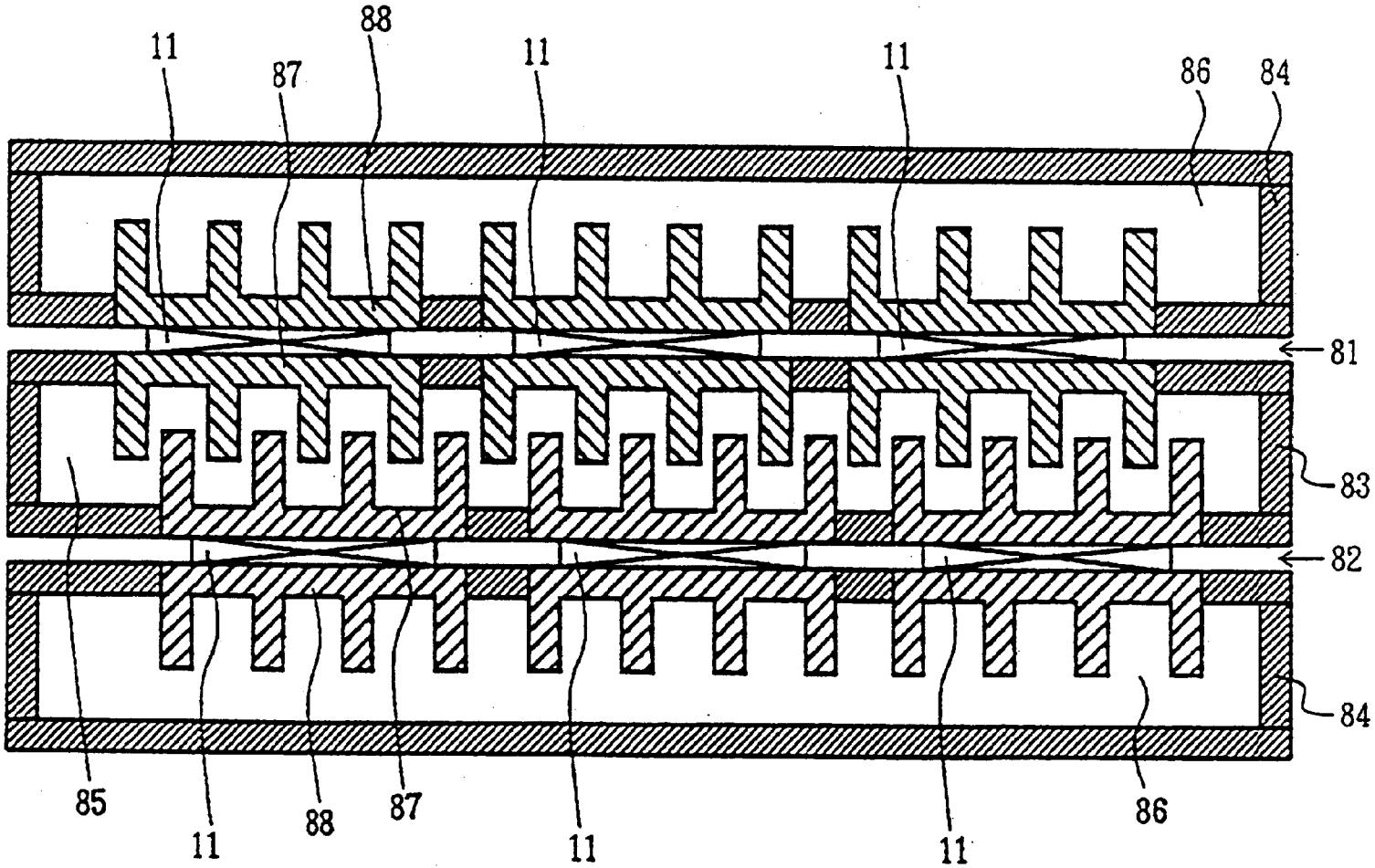
FIG. 9 is a sectional view taken along the line B—B of FIG. 10, showing a heat exchange section in a fourth embodiment of the present invention.
Figure 10:
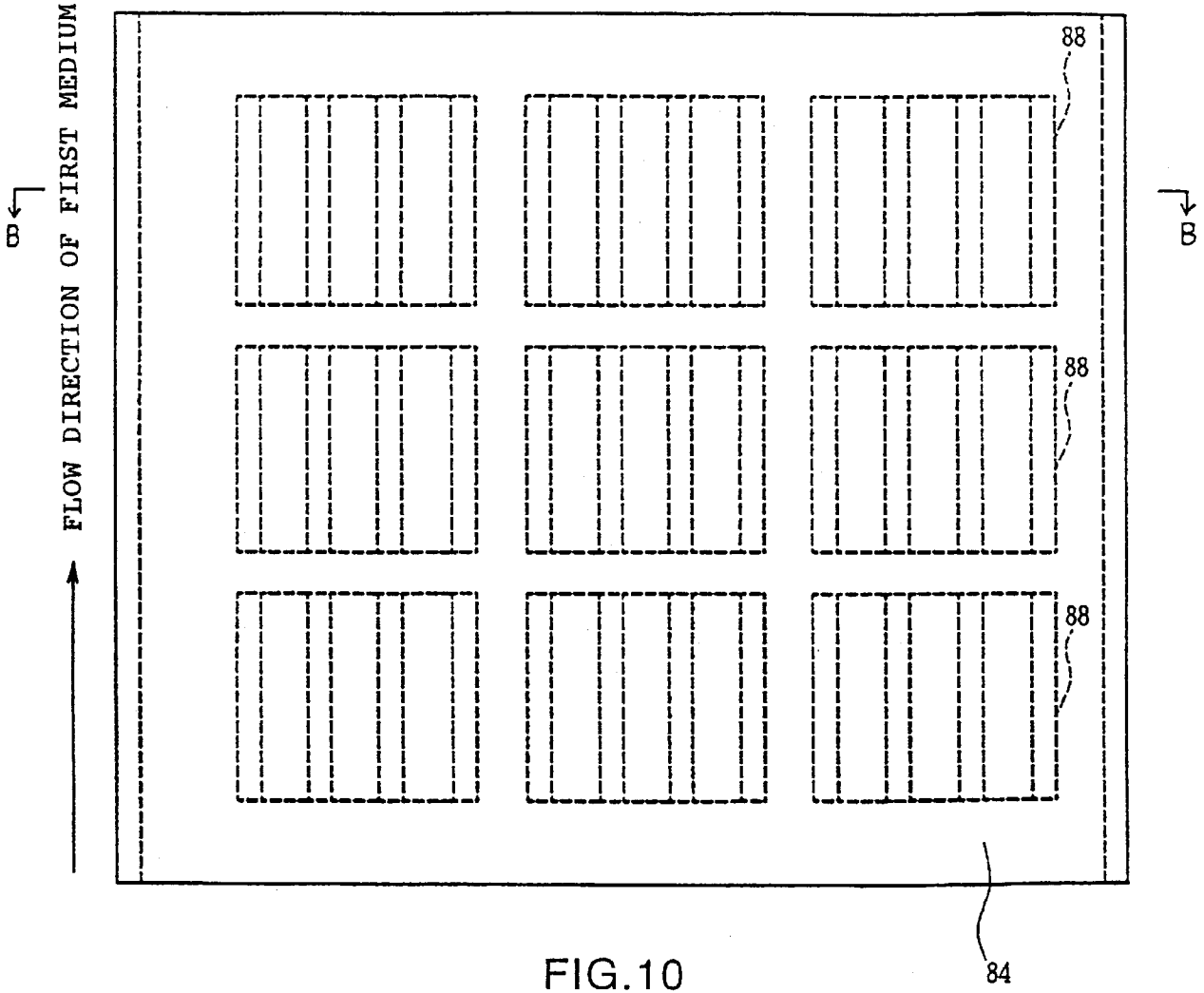
FIG. 10 is an elevational view showing the heat exchange section in the fourth embodiment.

In the fourth embodiment, the array of the thermoelectric elements 11 of the first embodiment is modified as shown in FIGS. 9 and 10, as well as the first and second heat exchangers 7 and 8 of the first embodiment are replaced with first and second heat exchangers 83 and 84 as illustrated.

In the fourth embodiment as shown in FIGS. 9 and 10, two thermoelectric element arrayed surfaces 81 and 82 are provided, each of which is formed by a plurality of thermoelectric elements 11 arrayed longitudinally and laterally at predetermined intervals on the same plane. These two thermoelectric element arrayed surfaces 81 and 82 are disposed at a predetermined distance.

The first heat exchanger 83 for the heat exchange with the first medium is disposed to define a first medium passage 85 between the thermoelectric element arrayed surfaces 81 and 82. The two second heat exchangers 84 for the heat exchange with the second medium are disposed to define second medium passages 86 on the outer sides of the thermoelectric element arrayed surfaces 81 and 82.

More specifically, as shown in FIG. 9, fins 87 made of thermally conductive material are closely contacted with the surface of each thermoelectric element 11 on the first medium passage 85 side. The outer peripheral portion of each fin 87 is closely contacted with the member forming the first heat exchanger 81. This member and the fins 87 cooperatively define the first medium passage 85.

Fins 88 made of thermally conductive material are closely contacted with the surface of each thermoelectric element 11 on the second medium passage 86 side. The outer peripheral portion of each fin 88 is closely contacted with the member forming the first heat exchanger 81. This member and the fins 88 cooperatively define the second medium passage 86.

In addition, the opposing fins 87 inside the first medium passage 85 are arranged to be offset from one another. This can make the width of the first medium passage narrower.

Similarly to the first embodiment, the electric current supplied to the thermoelectric elements 11 is controlled so that the temperature detected by the temperature sensor 28 becomes equal to the target value.

Next, a fifth embodiment of the present invention will be described with reference to FIGS. 11 and 12.

Figure 11:
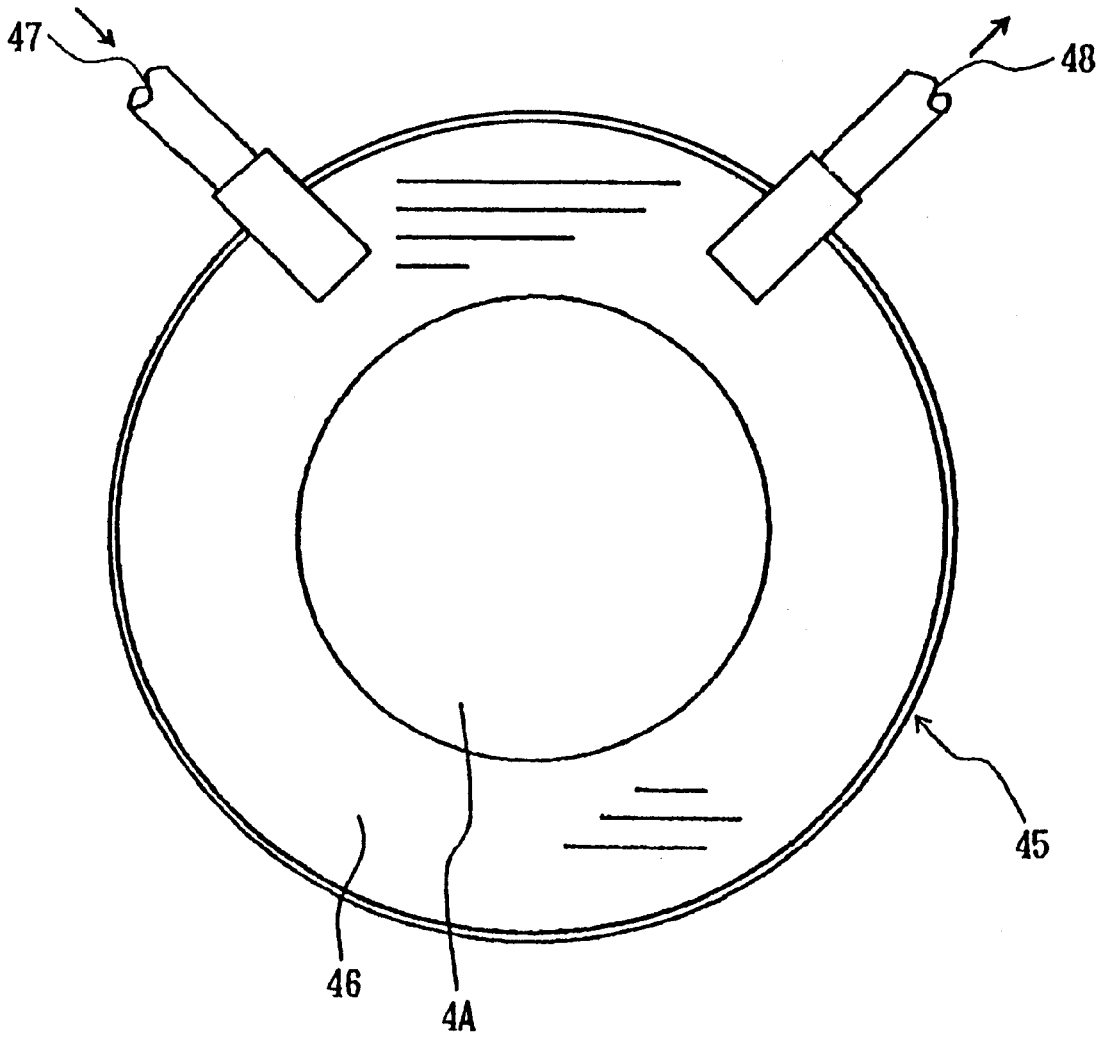
FIG. 11 is a view showing an arrangement of a cooling jacket in a fifth embodiment of the present invention.
Figure 12:
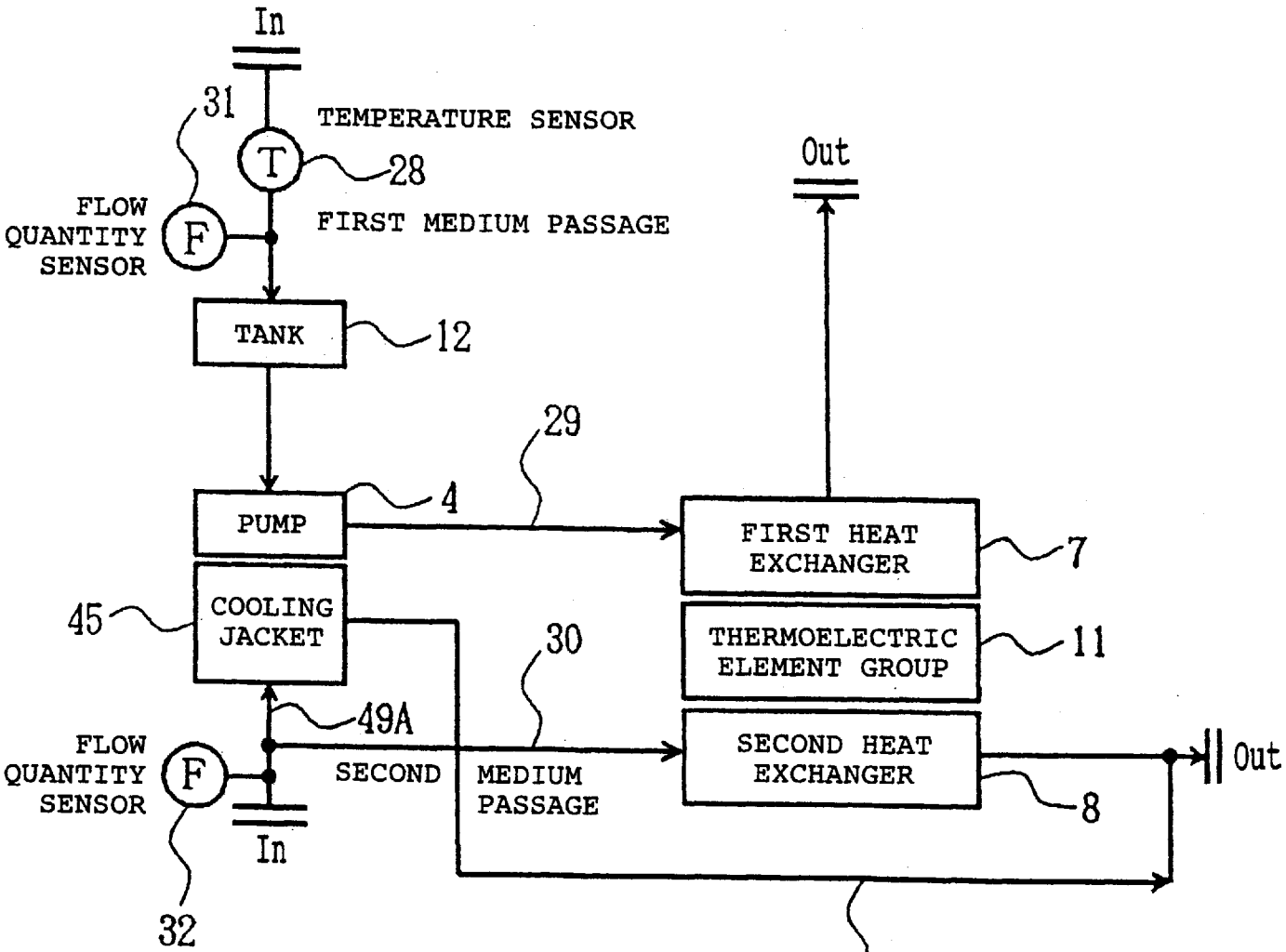
FIG. 12 is a schematic view showing a piping arrangement in the fifth embodiment.

The fifth embodiment is provided with a cooling jacket 45 as shown in FIG. 11 so as to prevent the heat generation from the pump 4 in each of the first to fourth embodiments.

As shown in FIG. 11, this cooling jacket 45 is arranged such that a cooling tank 46 is disposed around the motor portion 4A of the pump 4, and the second medium to be supplied to the second medium passage 30 can be partially introduced into and discharged from the inside of the cooling tank 46.

An introducing hole 47 of the cooling tank 46 is connected to a bypass passage 49A branched from a portion of the upstream side of the second medium passage 30, and a discharge hole 48 is connected to a discharge passage 49B.

The structure of other portions of the fifth embodiment is the same as each of first to fourth embodiments, so that the description therefor is omitted.

Next, a sixth embodiment of the present invention will be described with reference to FIG. 13.

The aforementioned fifth embodiment has a drawback in that the temperature adjustment cannot be made for the second medium flowing in the second heat exchangers 8.

Figure 13:
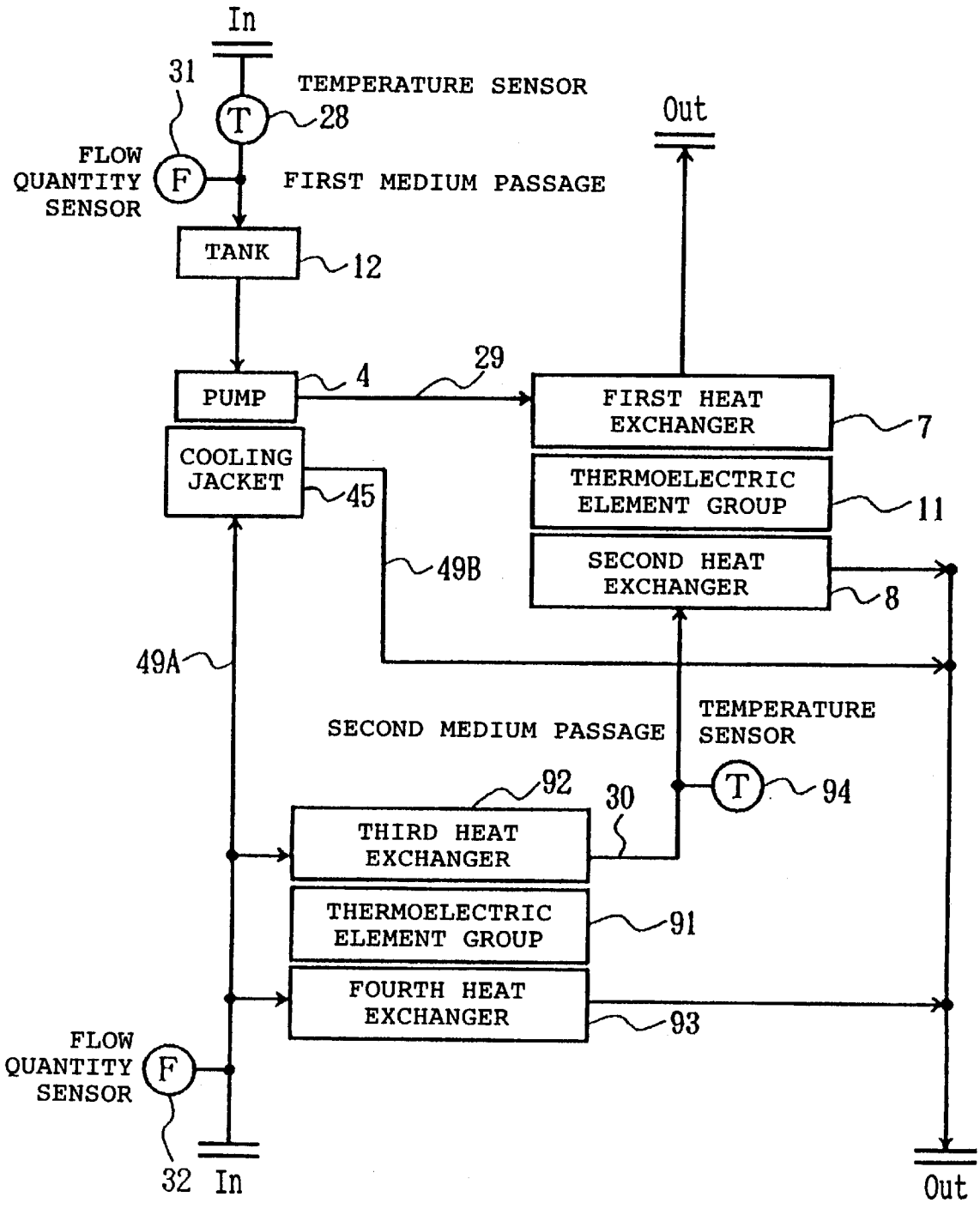
FIG. 13 is an explanatory diagram for schematically showing an arrangement of a sixth embodiment of the present invention.

To overcome this drawback, as shown in FIG. 13, the sixth embodiment is additionally provided with single or plural thermoelectric elements 91 for heating and cooling the second medium supplied to the second heat exchanger 8, a third heat exchanger 92 which performs the heat exchange by contacting the second medium with one surfaces of the thermoelectric elements 91, and a fourth heat exchanger 93 which performs the heat exchanger by contacting a portion of the second medium with the other sides of the thermoelectric elements 91.

Further, as shown in FIG. 13, the sixth embodiment has a temperature sensor 94 provided in a portion of the second medium passage 30 between the second and third heat exchangers 8 and 92 to detect the temperature of the second medium flowing in the second heat exchanger 8. A controller (not shown) detects the temperature of the temperature sensor 94, and controls the electric current supplied to the thermoelectric elements 91 so that the detected temperature becomes equal to a target value.

Next, a seventh embodiment of the present invention will be described with reference to FIG. 14.

In the aforementioned sixth embodiment, the second medium flowing in the second heat exchanger 8 is discharged, and consequently the temperature adjustment is not so appropriate.

Figure 14:
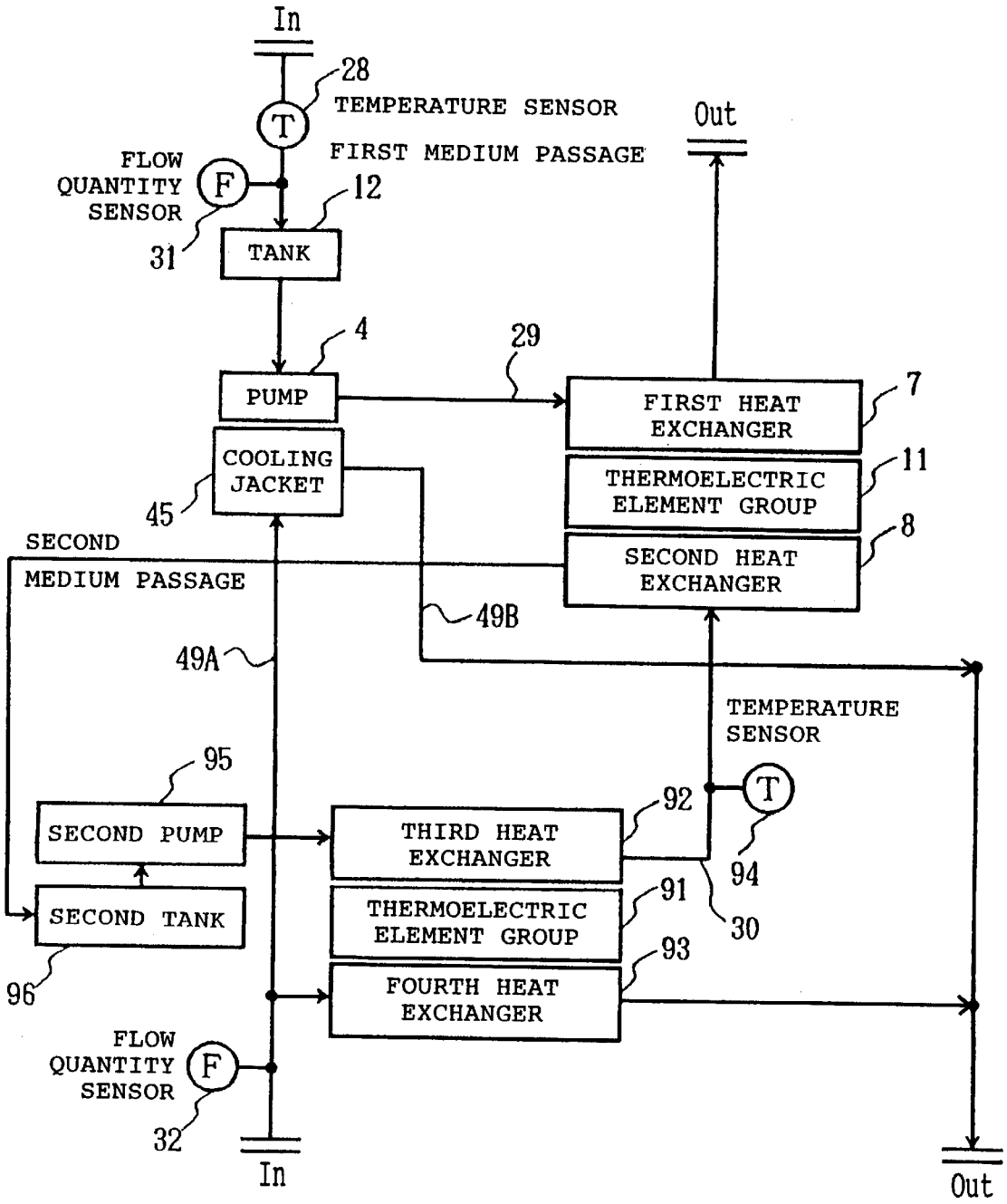
FIG. 14 is an explanatory diagram for schematically showing an arrangement of a seventh embodiment.

To solve this problem, as shown in FIG. 14, the seventh embodiment is additionally provided with a second pump 95 and a second tank 96. The second pump 95 circulates the second medium to pass through the third heat exchanger 92, the second heat exchanger 8, the second tank 96 and the second pump 95. The thermoelectric elements 91, the third heat exchanger 92, the fourth heat exchanger 93, the second pump 95 and the second tank 96 are installed inside the outer case 3 shown in FIG. 1.

In the seventh embodiment, a controller (not shown) detects the temperature of the temperature sensor 94, and controls the electric current supplied to the thermoelectric elements 91 so that the detected temperature becomes equal to a target value.

As described above, according to the present invention, the thermoelectric elements, and the first and second heat exchangers are accommodated within the air-tight container, and the vacuum condition is realized. Therefore, it is possible to prevent the formation of dew on the thermoelectric elements, thereby improving the thermoelectric elements in reliability and life cycle. Further, thanks to the thermally insulative effect, the heat exchange efficiency is improved.

Further, according to the present invention, the use of the skeleton type thermoelectric elements as the thermoelectric elements can decrease the thermal resistance, thereby improving the performance of heating and cooling the thermally conductive medium.

Further, according to the present invention, since the temperature adjusting means is provided for adjusting the temperature of the second medium to be constant, the heat exchange efficiency of the medium can be enhanced.

Furthermore, according to the present invention, a plurality of the thermoelectric elements are arranged at predetermined intervals circumferentially and longitudinally to form a hollow tetrahedron, the first heat exchanger is formed inside the tetrahedron, and the second heat exchangers are disposed on the outer sides of the tetrahedron concentrically to the first heat exchanger. Therefore, the temperature of the first medium can be made uniform.

Moreover, according to the present invention, the thermoelectric elements are arrayed at predetermined intervals longitudinally and laterally on the two plane confronted with each other at a predetermined distance to form the two thermoelectric element arrayed surfaces, the first heat exchanger is formed between the thermoelectric element arrayed surfaces, and the second heat exchangers are disposed on the outer sides of the thermoelectric element arrayed surfaces. Therefore, the temperature of the first medium can be made uniform, and the heat exchange section can be made compact.

What is claimed is:

1. A temperature adjusting device comprising: an air-tight container; a thermoelectric element disposed in the air-tight container and having first and second opposite surfaces each capable of radiating and absorbing heat through a Peltier effect; a first heat exchanger disposed in the air-tight container for performing heat exchange between a thermally conductive first medium and the first surface of said thermoelectric element; a tank disposed in the air-tight container and connected to an inlet side of said first heat exchanger for storing the first medium; a second heat exchanger disposed in the air-tight container for performing heat exchange between a thermally conductive second medium and the second surface of said thermoelectric element; a pump for circulating the first medium through said first heat exchanger; a temperature sensor for detecting a temperature of the first medium circulated by the pump; and control means for controlling an electric current supplied to said thermoelectric element so that a temperature detected by the temperature sensor becomes equal to a preselected temperature value.

2. A temperature adjusting device as set forth in claim 1; wherein the thermoelectric element comprises a skeleton-type Peltier element.

3. A temperature adjusting device as set forth in claim 1; further comprising a vacuum pump for decreasing the pressure of the air-tight container.

4. A temperature adjusting device as set forth in claim 1; wherein the air-tight container contains dry air.

5. A temperature adjusting device as set forth in claim 1; wherein the first medium and the second medium each comprise a gas having high electrically insulative and thermally conductive properties.

6. A temperature adjusting device as set forth in claim 1; further comprising temperature adjusting means for adjusting a temperature of the second medium to maintain the temperature of the second medium constant.

7. A temperature adjusting device as set forth in claim 6; wherein the temperature adjusting means comprises a thermoelectric element for heating and cooling the second medium, a tank for storing the second medium therein, a pump for circulating the second medium, a temperature sensor for detecting a temperature of the second medium, and control means for controlling an electric current supplied to said thermoelectric element of the temperature adjusting means so that the temperature detected by the temperature sensor of the temperature adjusting means becomes equal to a preselected temperature value.

8. A temperature adjusting device as set forth in claim 1; wherein the air-tight container contains a dry inert gas.

9. A temperature adjusting device as set forth in claim 1; wherein the first medium and the second medium each comprise a liquid having high electrically insulative and thermally conductive properties.

10. A temperature adjusting device comprising: an air-tight container; a thermoelectric element disposed in the air-tight container and having first and second opposite surfaces each capable of radiating and absorbing heat through a Peltier effect; a first heat exchanger disposed in the air-tight container for performing heat exchange between a thermally conductive first medium and the first surface of the thermoelectric element; a second heat exchanger disposed in the air-tight container for performing heat exchange between a thermally conductive second medium and the second surface of the thermoelectric element; a pump for circulating the first medium through the first heat exchanger, a heat generated from the pump being radiated by the second medium supplied to the second heat exchanger; a temperature sensor for detecting a temperature of the first medium circulated by the pump; and control means for controlling an electric current supplied to the thermoelectric element so that a temperature detected by the temperature sensor becomes equal to a preselected temperature value.

11. A temperature adjusting device as set forth in claim 10; further comprising a tank disposed in the air-tight container and connected to an inlet side of said first heat exchanger for storing the first medium.

12. A temperature adjusting device comprising: an air-tight container; a thermoelectric element disposed in the air-tight container and having first and second opposite surfaces each capable of radiating and absorbing heat through a Peltier effect; a first heat exchanger disposed in the air-tight container for performing heat exchange between a thermally conductive first medium and the first surface of the thermoelectric element, the first heat exchanger having a member in contact with the thermoelectric element, the member having comb-type fins, and each of the comb-type fins having pleats; a second heat exchanger disposed in the air-tight container for performing heat exchange between a thermally conductive second medium and the second surface of the thermoelectric element, the second heat exchanger having a member in contact with the thermoelectric element, the member having comb-type fins, and each of the comb-type fins having pleats; a pump for circulating the first medium through the first heat exchanger; a temperature sensor for detecting a temperature of the first medium circulated by the pump; and control means for controlling an electric current supplied to the thermoelectric element so that a temperature detected by the temperature sensor becomes equal to preselected temperature value.

13. A temperature adjusting device as set forth in claim 12; further comprising a tank disposed in the air-tight container and connected to an inlet side of the first heat exchanger for storing the first medium.

14. A temperature adjusting device comprising: an air-tight container; a thermoelectric element disposed in the air-tight container and having first and second opposite surfaces each capable of radiating and absorbing heat through a Peltier effect; a heat exchanger tank disposed in the air-tight container for storing a thermally conductive first medium and performing heat exchange between the first medium and the first surface of the thermoelectric element; a heat exchanger disposed in the air-tight container for performing heat exchange between a thermally conductive second medium and the second surface of the thermoelectric element; a pump for circulating the first medium through the heat exchanger tank; a temperature sensor for detecting a temperature of the first medium circulated by the pump; and control means for controlling an electric current supplied to the thermoelectric element so that a temperature detected by the temperature sensor becomes equal to a preselected temperature value.

15. A temperature adjusting device as set forth in claim 14; wherein the heat exchanger tank is divided into a plurality of vessels by a plurality of walls provided at predetermined intervals in a longitudinal direction, the walls being respectively provided with communication holes arranged at predetermined angular intervals in a circumferential direction perpendicular to the longitudinal direction so as to communicate the vessels to one another.

16. A temperature adjusting device comprising: an air-tight container; a plurality of thermoelectric elements disposed in the air-tight container and arranged at predetermined intervals in circumferential and longitudinal directions to form a hollow tetrahedron, each of the thermoelectric elements having first and second opposite surfaces capable of radiating and absorbing heat through a Peltier effect; a first heat exchanger disposed in the air-tight container and inside of the tetrahedron for performing heat exchange between a thermally conductive first medium and the first surface of the thermoelectric elements; a plurality of second heat exchangers disposed in the air-tight container for performing heat exchange between a thermally conductive second medium and the second surface of the thermoelectric elements, the second heat exchangers being disposed outside of the tetrahedron and concentrically to the first heat exchanger; a pump for circulating the first medium through the first heat exchanger; a temperature sensor for detecting a temperature of the first medium circulated by the pump; and control means for controlling an electric current supplied to the thermoelectric elements so that a temperature detected by the temperature sensor becomes equal to a preselected temperature value.

17. A temperature adjusting device as set forth in claim 16; further comprising a tank disposed in the air-tight container and connected to an inlet side of the first heat exchanger for storing the first medium.

18. A temperature adjusting device comprising: an air-tight container; a plurality of thermoelectric elements disposed in the air-tight container and arranged on a plane in an array at predetermined intervals in circumferential and longitudinal directions of the plane to form two thermoelectric element-arrayed surfaces, each of the thermoelectric elements having first and second opposite surfaces capable of radiating and absorbing heat through a Peltier effect; a first heat exchanger disposed between the thermoelectric element-arrayed surfaces for performing heat exchange between a thermally conductive first medium and the first surface of the thermoelectric elements; a plurality of second heat exchangers disposed in the air-tight container and on outer sides of the thermoelectric element-arrayed surfaces for performing heat exchange between a thermally conductive second medium and the second surface of the thermoelectric elements; a pump for circulating the first medium through the first heat exchanger; a temperature sensor for detecting a temperature of the first medium circulated by the pump; and control means for controlling an electric current supplied to the thermoelectric elements so that a temperature detected by the temperature sensor becomes equal to preselected temperature value.

19. A temperature adjusting device as set forth in claim 18; further comprising a tank disposed in the air-tight container and connected to an inlet side of the first heat exchanger for storing the first medium.

* * * * *